US009234346B2

(12) United States Patent
Sakamoto

(10) Patent No.: US 9,234,346 B2
(45) Date of Patent: Jan. 12, 2016

(54) CASSETTE-VIBRATION ISOLATION DEVICE

(71) Applicant: Miho Sakamoto, Tsuchiura-shi (JP)

(72) Inventor: Shoichi Sakamoto, Tsuchiura (JP)

(73) Assignee: Onoda Construction, Shizuoka (JP)

( * ) Notice: Subject to any disclaimer, the term of this patent is extended or adjusted under 35 U.S.C. 154(b) by 0 days.

(21) Appl. No.: 14/357,831

(22) PCT Filed: Nov. 12, 2012

(86) PCT No.: PCT/JP2012/079315
§ 371 (c)(1),
(2) Date: May 13, 2014

(87) PCT Pub. No.: WO2013/073507
PCT Pub. Date: May 23, 2013

(65) Prior Publication Data

US 2014/0318041 A1 Oct. 30, 2014

(30) Foreign Application Priority Data

Nov. 14, 2011 (JP) ..... 2011-249098

(51) Int. Cl.
*E04H 9/02* (2006.01)
*E04B 1/98* (2006.01)

(52) U.S. Cl.
CPC *E04B 1/985* (2013.01); *E04H 9/02* (2013.01); *E04H 9/021* (2013.01); *E04H 9/028* (2013.01); *E04H 2009/026* (2013.01)

(58) Field of Classification Search
CPC ..... E04H 9/02; E04H 9/028; E04H 9/029; E04H 2009/026; E04B 1/985; E04B 1/98
USPC ..... 52/167.1, 167.4, 168, 2.22; 248/636, 248/638; 267/226
See application file for complete search history.

(56) References Cited

U.S. PATENT DOCUMENTS

| | | | | |
|---|---|---|---|---|
| 1,847,820 | A * | 3/1932 | De Montalk | 52/167.4 |
| 3,455,538 | A * | 7/1969 | Vranian | 254/89 R |
| 4,771,581 | A * | 9/1988 | Nill | 52/2.11 |

(Continued)

FOREIGN PATENT DOCUMENTS

| | | | | |
|---|---|---|---|---|
| DE | 3905208 | A1 * | 8/1990 | E02D 27/34 |
| DE | 4223786 | A1 * | 1/1994 | |
| JP | S57-69288 | | 4/1982 | |
| JP | 02-153139 | | 6/1990 | |
| JP | 06-323036 | | 11/1994 | |

(Continued)

*Primary Examiner* — Brian Glessner
*Assistant Examiner* — Babajide Demuren
(74) *Attorney, Agent, or Firm* — Greer, Burns & Crain, Ltd.

(57) ABSTRACT

Provided is a cassette-vibration isolation device that is easy to upkeep (maintain) and that can cause a heavy structure to rise during an earthquake. The device is provided with an upper base and a lower base that are arranged so that the bottom surface of the upper base faces the upper surface of the lower base; a cavity, which is formed between the upper base and the lower base, and the inside of which is filled with fluid; sealing members, which are provided in an attachable/detachable manner along the inner walls of the cavity, and which maintain the state wherein the cavity is filled with fluid; and a valve, which connects the cavity and a fluid-supply source, and which supplies fluid to the inside of the cavity. During an earthquake, the upper base can rise from the lower base due to the supply of fluid via the valve to the inside of the cavity.

8 Claims, 7 Drawing Sheets

(56) References Cited

U.S. PATENT DOCUMENTS

| | | | | |
|---|---|---|---|---|
| 5,363,610 | A * | 11/1994 | Thomas et al. | 52/167.8 |
| 2011/0037209 | A1 * | 2/2011 | Yin | 267/140.12 |

FOREIGN PATENT DOCUMENTS

| | | |
|---|---|---|
| JP | 10-184095 | 7/1998 |
| JP | 2011-202769 | 10/2011 |

* cited by examiner

CASSETTE-VIBRATION ISOLATION DEVICE

TECHNICAL FIELD

This invention relates to a cassette-vibration isolation device. More specifically, this invention relates to a cassette-vibration isolation device that can protect a structure such as a building by causing the structure to rise when an earthquake occurs, so as to prevent earthquake vibrations from being transmitted to the structure. In particular, this invention relates to a cassette-vibration isolation device that can be incorporated into heavy structures such as high-rise buildings and nuclear-power reactors.

BACKGROUND ART

There have been developed base-isolation devices that cause a structure to rise so as to prevent earthquake vibrations from being transmitted to the structure so as to protect the structure from the earthquake. Patent Document 1, for example, discloses a base-isolation device that is configured such that an upper base on which a building is placed is provided so as to contact the surface of a lower base, which is on the ground, and to introduce pressurized gas between the lower surface of the upper base and the upper surface of the lower base, thereby causing the upper base to rise from the lower base, thereby lifting the building. However, although this base-isolation device of Patent Document 1 can lift an ordinary house, it would be extremely difficult for that device to lift a heavy structure such as a high-rise building or a nuclear-power reactor.

Patent Document 2 discloses a base-isolation device that is intended to be used for heavy nuclear-reactor structures. In this device, multiple partitioned spaces are formed underneath a nuclear-reactor structure, between the bottom of the structure and its foundation in the ground, and the partitioned spaces are filled with a pressurized fluid such as oil or water, so as to isolate the nuclear-reactor structure from vibrations of the ground during an earthquake. However, even in an ordinary state in which no earthquake is occurring, pressurized fluid must continue to be filled into this device, which is rather troublesome. In addition, this device does not cause the nuclear-reactor building to rise, and therefore if vibrations due to an earthquake are large, the vibrations might be transmitted to the building and cause damage.

PRIOR ART DOCUMENTS

Patent Documents

Patent Document 1: JP-A-2011-202769
Patent Document 2: JP-A-557-69288

SUMMARY OF THE INVENTION

Objectives of the Invention

The objectives of the present invention are to provide a cassette-vibration isolation device that is easy to maintain, and that can lift a heavy building to rise during an earthquake.

Means of Achieving the Objectives

The cassette-vibration isolation device of the present invention (1) includes (a) an upper base and a lower base that are arranged so that the bottom surface of the upper base faces the upper surface of the lower base; (b) a cavity that is between the upper base and the lower base and that is filled with a fluid; (c) a sealing member that is attachably and detachably provided along the inner walls of the cavity, and that maintains the fluid filled inside the cavity; and (d) a valve that connects the cavity with a fluid-supply source and that supplies the fluid to the inside of the cavity; and (2) causes, during an earthquake, the upper base to rise from the lower base due to fluid being supplied from the valve to the inside of the cavity.

The sealing members of the cassette-vibration isolation device are (1) configured so that their widths can be adjusted to the widths of the compartments into which the cavity is divided, and (2) connected to one another in the direction of their insertion into the cavity.

The cassette-vibration isolation device also includes a storage section into which the fluid in the cavity flows and in which the fluid is stored.

The cassette-vibration isolation device also includes a returning means that applies pressure to the upper base after the upper base has been raised, and that lowers the upper base to its original position.

The sealing member (Type 1) includes (1) a peripheral frame arranged along the inner walls of the cavity, and (2) a thin sealing plate that is arranged along the entire inner circumference of the peripheral frame and that elastically contacts the upper and lower surfaces of the cavity, whereby the sealing member can easily be attached to and detached from the cavity by being inserted into and withdrawn from the inside of the cavity.

The valve of the cassette-vibration isolation device has (1) a double-pipe structure that includes (a) an outer pipe that is fixed on the upper base when the outer pipe penetrates though the upper base, and (b) an inner pipe that is inserted into the outer pipe so as be movable up and down relative to the outer pipe, and that has a fluid-discharge port that is formed on the lower part of the inner pipe and opened to the inside of the cavity; and (2) a fluid-injection port that is formed at corresponding positions in the inner pipe and the outer pipe, whereby the relative movement of the inner pipe and the outer pipe, due to the rise of the upper base, establishes or breaks a connection between the injection port of the inner pipe and the injection port of the outer pipe.

The sealing member of the cassette-vibration isolation device includes (1) a rectangular metal base plate that has multiple through holes; (2) an upper sealing blade that extends along the periphery of the upper surface of the base plate; and (3) a lower sealing blade that extends along the periphery of the lower surface of the base plate, whereby the sealing member can easily be attached to and detached from the cavity by being inserted into and withdrawn from the inside of the cavity.

The cassette-vibration isolation device includes multiple jack-type absorbers between the upper base and the lower base. The weight of a building, including the upper base, is supported by the oil pressure of the jack-type absorber in an ordinary state. When an earthquake is detected, the outlet valve of the jack-type absorber is opened so as to decrease the internal pressure of the jack-type absorber, so that the upper base moves down so as to increase the pressure of the fluid that has filled the cavity, whereby, even before the valve supplies the fluid into the cavity, the shocks of the earthquake are absorbed.

The fluid-supply source of the cassette-vibration isolation device includes an oil tank that stores the fluid, an oil pump that pumps the fluid upward from the oil tank, and an oil chamber that compresses and stores the fluid, whereby the fluid is sent from the oil chamber to the valve.

A valve is provided to each of the multiple sealing members, which are provided so that they divide the cavity into separate sections.

Advantageous Effects of the Invention

The cassette-vibration isolation device of the present invention includes a cavity between the upper base and lower base, and a sealing member that can be inserted into and removed from the cavity, like a cassette, is provided, so that when an earthquake occurs fluid is supplied into the cavity. Accordingly, the cassette-vibration isolation device of the present invention can cause a heavy structure, including an upper base, to rise, so as to protect the structure from the earthquake. Therefore, it is not necessary for the device of this invention to constantly supply fluid into the cavity. The sealing member is made to be removable, and therefore maintenance of the sealing member, including repair and inspection, is easily made.

The sealing members are configured so that their widths can be adjusted to the widths of the compartments into which the cavity is divided, and so that the sealing members can be connected to one another in the direction of their insertion into the cavity, and therefore it is easy for the sealing member to be inserted into and withdrawn from the cavity.

A storage section. The cassette-vibration isolation device includes a storage section, so that, even if the fluid supplied into the inside of the sealing member leaks from openings in the device and fills the cavity, the fluid is made to flow into the storage section and to be stored therein. Therefore, the fluid does not flow out of the device, and thus the device is environmentally friendly.

There is provided a returning means that lowers the upper base to its original position, and therefore even if the building has been displaced from its original position, the returning means returns the building to its original position after an earthquake has stopped.

The sealing member (Type 1) includes a peripheral frame and a thin sealing plate that is provided along the entire inner circumference of the peripheral frame and that elastically contacts the upper and lower surfaces of the cavity, and therefore (1) the sealing member can easily be attached to and detached from the cavity by being inserted into and withdrawn from the cavity; (2) the fluid is securely sealed by the sealing member; and (3) the sealing member is easy to install and to maintain.

There is provided a valve that has a double-pipe structure that includes an outer pipe and an inner pipe, and that allows the injection ports of the double pipe to establish or break a connection between the injection ports, and therefore the supply of the fluid and the supply of the fluid is automatically stopped according to the rise of the building. The opening of the valve is automatically adjusted according to how high a building is lifted.

The sealing member (Type 2) is a rectangular metal base plate, and therefore the sealing member (Type 2) resists deformation because it is not necessary for the four corners of the sealing member to be welded together. Multiple through holes provided on the base plate allow the fluid provided to the lower side of the base plate to be introduced into the upper side of the base plate.

Multiple jack-type absorbers are provided between the upper base and the lower base, which allows the building to cope with an earthquake occurring directly underneath the building's location. During such an earthquake that cannot be coped with by a conventional control in which a sensor detects P waves and fluid is then sent to the sealing member, a jack-type absorber can prevent the upper base from receiving a significant shock, because the piston of the jack-type absorber is pushed down due to the shock of the earthquake and the release of the oil pressure of the jack-type absorber so as to move the piston down.

The fluid-supply source includes an oil chamber that compresses and stores the fluid ejected from an oil pump, and therefore the fluid can immediately be immediately sent to the valve when an earthquake occurs.

Each of the multiple sealing members includes a valve that automatically adjusts how much the building is raised. Therefore, even if a part of the building is heavier than another part of the building and thus the load of the building is not evenly distributed, the upper base and the building are able to rise horizontally, even though the time required to close the valves varies.

BRIEF DESCRIPTIONS OF THE DRAWINGS

Figure 9:
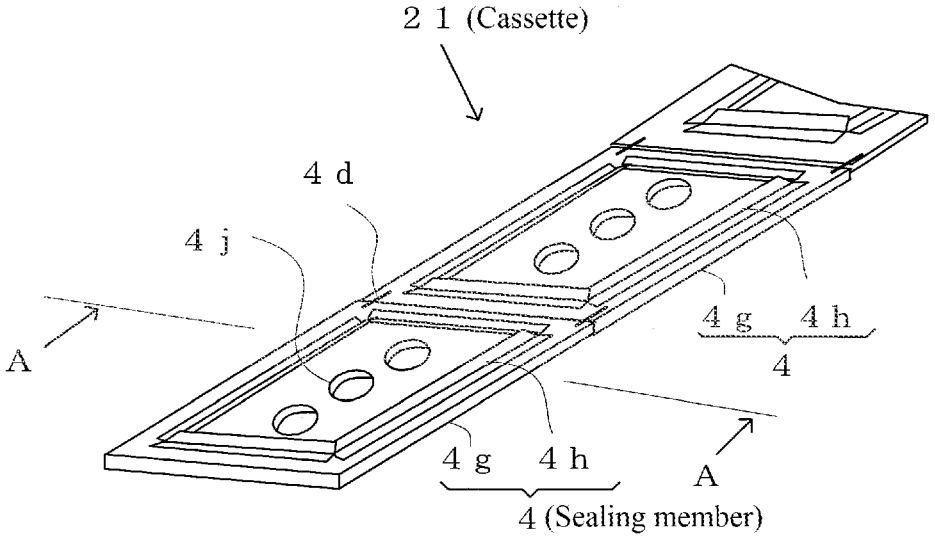
FIG. 9 shows another example of the sealing member (Type 2).

FIGS. 10(A) and 10(B) are sectional views of the sealing member viewed along the line indicated by A-A in FIG. 9. FIG. 10(A) shows the state of the sealing member when the device of the present invention does not cause the upper base to rise, and FIG. 10(B) shows the state when the device causes the upper base to rise.

Figure 11:
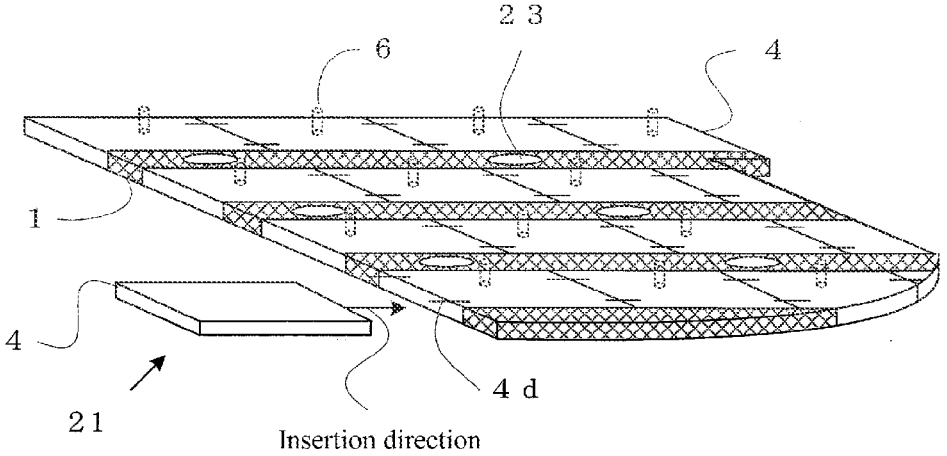

FIG. 11 is a perspective view of the state in which sealing members are laid underneath a building.

Figure 12:
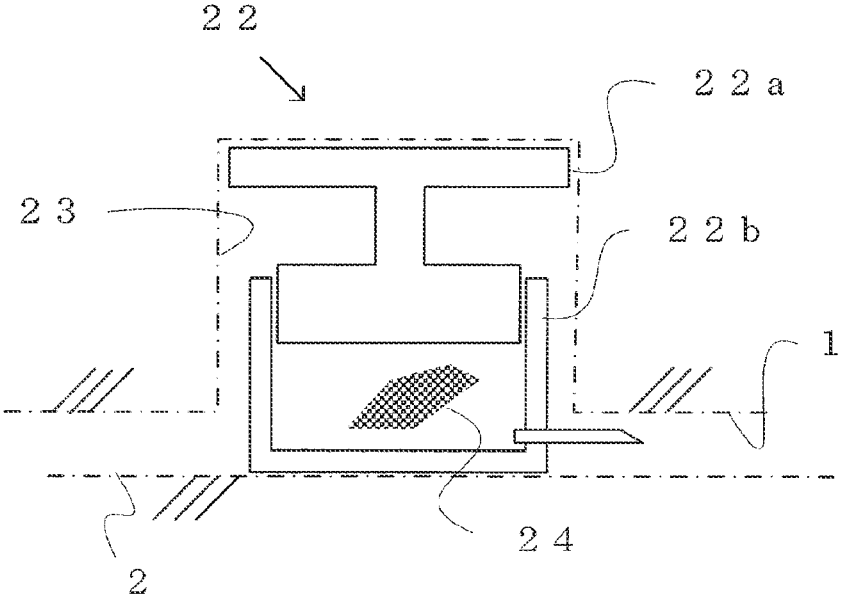

FIG. 12 is a sectional view of a jack-type absorber.

Figure 13:
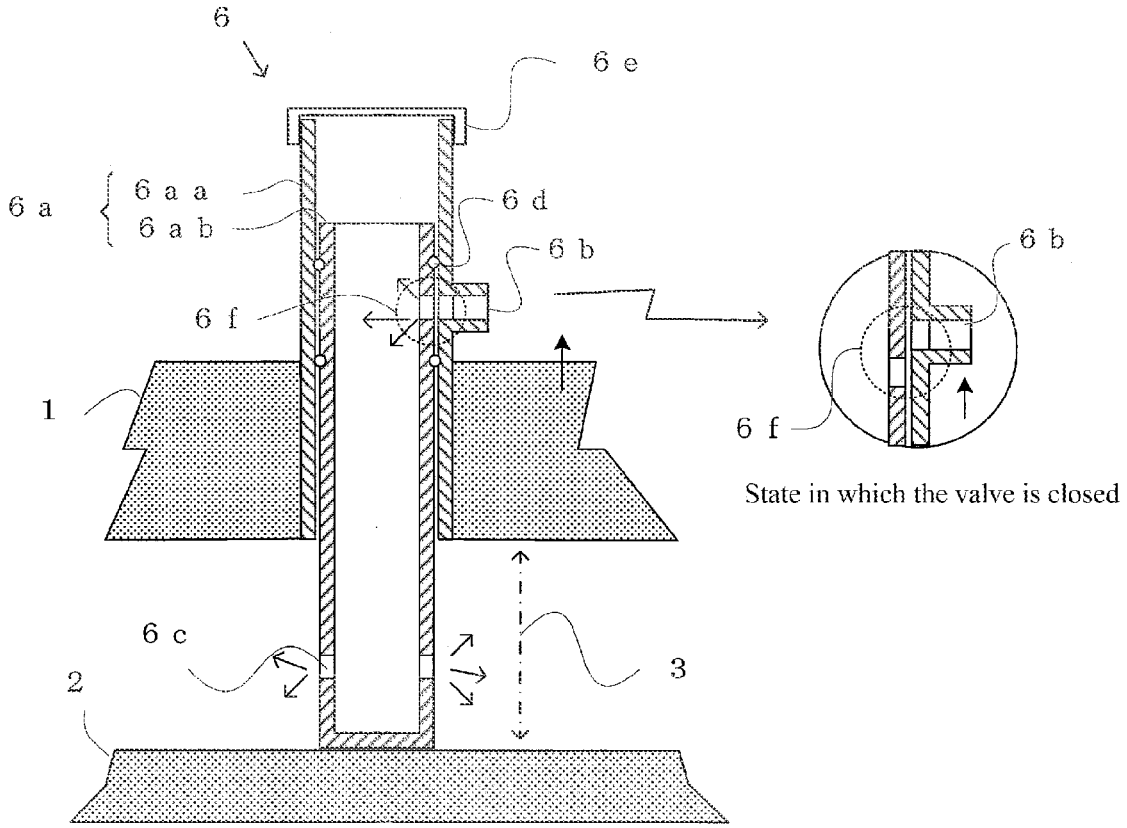

FIG. 13 is a sectional view of a valve.

Figure 14:
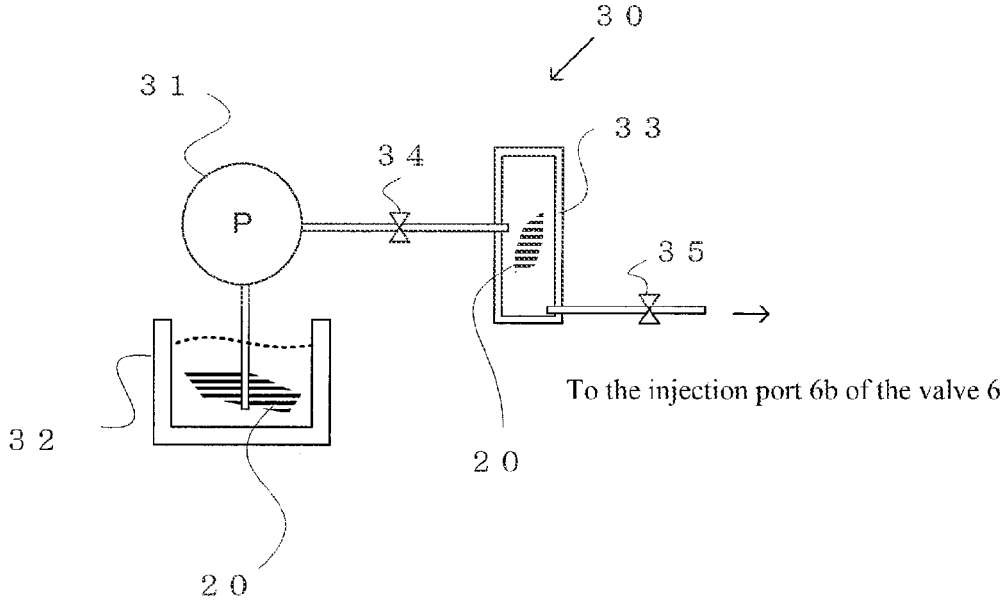

FIG. 14 is a drawing of a hydraulic-fluid supply device.

Figure 15:
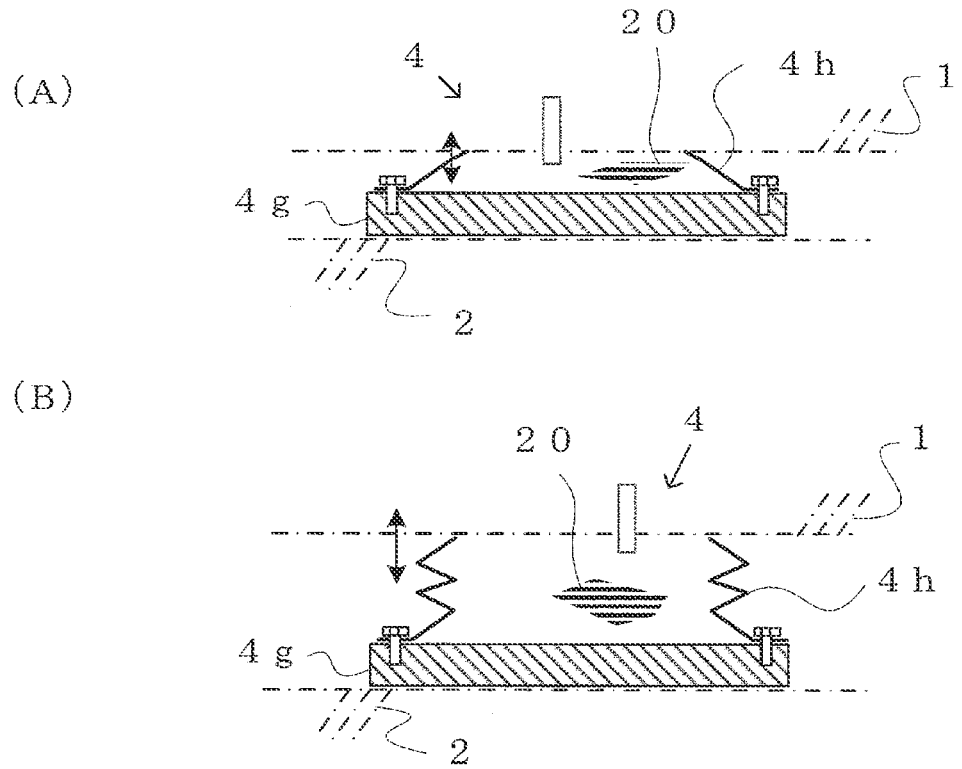

FIGS. 15(A) and 15(B) are sectional views showing other examples of the sealing member (Types 3 and 4). FIG. 15(A) shows an example in which a sealing blade is provided on one side of the sealing member, and FIG. 15(B) shows an example in which a sealing blade has a pleated shape.

Figure 16:
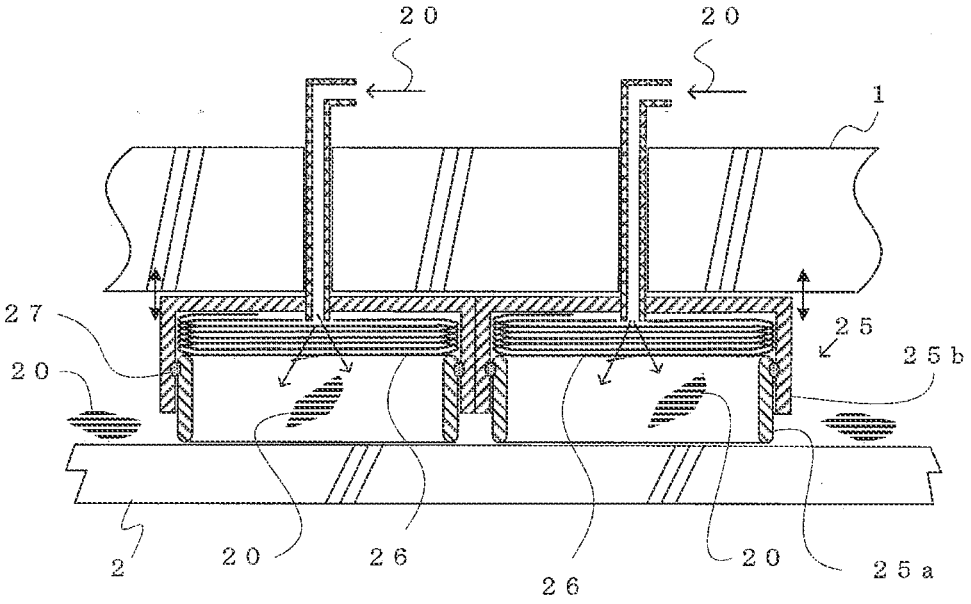

FIG. 16 is a sectional view of a high-pressure cylinder.

DESCRIPTIONS OF THE EMBODIMENTS

Embodiments of the cassette-vibration isolation device according to the present invention will be described below, referring to the drawings.

Embodiments

Figure 1:
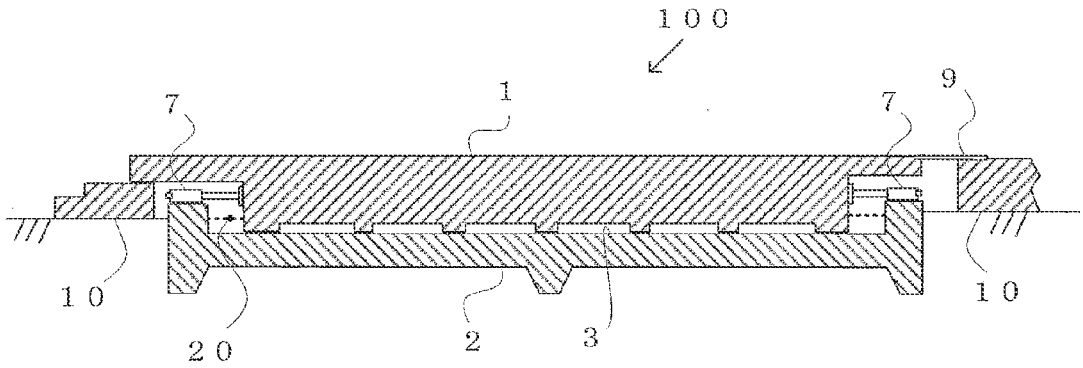
FIG. 1 is a sectional view of a cassette-vibration isolation device according to the present invention.

FIG. 1 is a sectional of the cassette-vibration isolation device according to the present invention. The cassette-vibration isolation device 100 includes an upper base 1 provided underneath a building and a lower base 2 provided on the ground so that the bottom surface of the upper base faces the upper surface of the lower base. Cavities 3 are formed between the upper base 1 and the lower base 2 when the upper base and lower base contact each other. The lower base 2 is located beneath the surface of the ground. A sill 10 is provided around, and engaged with, the periphery of the upper base 1. A lid 9 covers the space between the sill 10 and the upper base 1, so that a worker can enter that space to engage in maintenance of the cavities 3. As is shown in FIG. 1, returning means 7 are provided on the front, rear, and right and left sides of the lower base 2. The returning means 7 can be, for example, a hydraulic jack. If a building does not return to its original position after an earthquake, the building is pushed by the returning means 7 in the horizontal direction so that the position of the building can be adjusted. In addition, in an ordinary state, the cavities 3 are filled with fluid, more specifically with hydraulic fluid 20, although water can be used instead of hydraulic fluid 20, and the upper base 1 is raised by a jack-type absorber 22, which is described later, so that the legs of the upper base 1, which are the parts other than the cavities 3 of the upper base do not contact the lower base 2.

Figure 2:
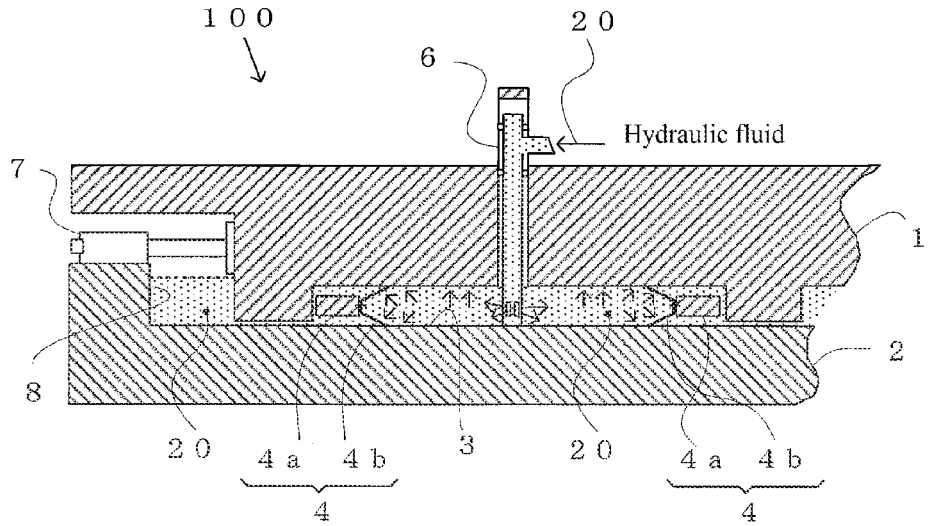
FIG. 2 is a sectional view of the cassette-vibration isolation device of FIG. 1, showing the state in which the device is causing a building to rise.

FIG. 2 is a sectional view of the cassette-vibration isolation device 100 of FIG. 1, showing the state in which the device lifts the building and the upper base 1. FIG. 2 is an enlarged view of the left-end portion of the device in FIG. 1. The cavity 3 is formed between the upper base 1 and the lower base 2, and hydraulic fluid 20 is injected into the cavity 3 so as to cause the upper base 1 to rise. The hydraulic fluid 20 is sent from an oil pump 31 (see FIG. 14) to a valve 6, whereby it is injected into a sealing member 4 that is in the cavity 3. The cavity 3 is closed by the sealing blades of the sealing plate 4*b* but there remains a space between the sealing blades of the sealing plate 4*b* of the sealing member 4 and the lower base 2, and therefore the hydraulic fluid 20 flows into a storage section 8, which is shown on the left side of the device in FIG. 1. The valve 6 connects the oil pump 31, which supplies the hydraulic fluid 20, and the cavity 3. If the supply of the hydraulic fluid 20 via the valve 6 to the cavity 3 is stopped, the upper base 1 moves down after a predetermined time has elapsed, and the hydraulic fluid 20 flows into the storage section 8, with the volume of the hydraulic fluid 20 flowing into the storage section 8 corresponding to the amount of downward movement of the upper base 1.

If hydraulic fluid 20 is injected into the inside of the sealing member 4 at a predetermined pressure, the sealing member 4 can maintain for a certain period the state that causes the upper base 1 to rise. This is why the sealing member 4 includes a peripheral frame 4*a* and a thin sealing plate 4*b* having sealing blades, so that even if the upper base 1 rises due to the injection of the hydraulic fluid 20, the pressure of the hydraulic fluid 20 causes the sealing plate 4*b* to bend, whereby the sealing plate tightly contacts the upper base 1 and the lower base 2. If the supply of the hydraulic fluid 20 from the valve 6 is stopped and a predetermined time has elapsed, the hydraulic fluid 20 flows into the storage section 8 through the opening between the sealing blade of the sealing plate 4*b* and the lower base 2, so that the upper base 1 moves down. Then, as shown in FIG. 1, the upper base 1 contacts the lower base 2.

If an earthquake occurs, P waves arrive first, and then S waves arrive. The device uses a sensor (not shown) to detects the P waves using a sensor (not shown), and actuates the oil pump 31. This causes the building to rise before S waves, which cause larger vibrations than P waves do, arrive. The hydraulic fluid 20 is supplied to the cavity 3 via the valve 6. Therefore, if several earthquakes occur in a relatively short time period, the hydraulic fluid 20 accumulates in the storage section 8. Subsequently, however, the accumulated hydraulic fluid 20 is returned via a separate pump to an oil tank 32 (see FIG. 14) that is the supply source of the hydraulic fluid 20. It can be assumed that after the earthquake, the upper base 1 might not return to a predetermined position relative to the lower base 2. In that ease, the position of the upper base 1 is easily adjusted by using the hydraulic jack of the returning means 7 to move the building, or by supplying the hydraulic fluid 20 to the cavities 3 via the valve 6 so as to keep the building raised.

Figure 3:
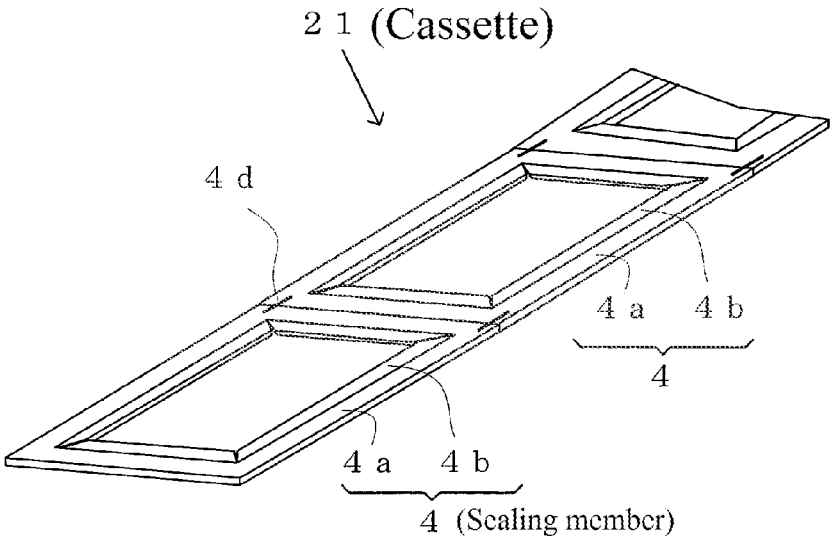
FIG. 3 is a perspective view of a sealing member (Type 1).

FIG. 3 is a perspective view of a sealing member (Type 1). FIG. 3 shows the state in which two sealing members 4 are connected by connector fittings 4*d*. The sealing member 4 is formed into a cassette 21. The sealing member 4 (Type 1) is configured of a peripheral frame 4*a* that is arranged along the inner walls of the cavity 3, and a thin sealing plate 4*b* along the entire inner circumference of the peripheral frame 4*a*, and that elastically contacts the upper and lower surfaces of the cavity 3. By being formed into a cassette, the sealing member 4 can easily be attached to and detached from the cavity 3 by being inserted into and withdrawn from the cavity 3. In order to facilitate the insertion and withdrawal of the sealing member 4, multiple sealing members 4 are connected to one another so as to form an elongated shape in the depth direction in accordance with the depth of the cavity 3.

Figure 4:
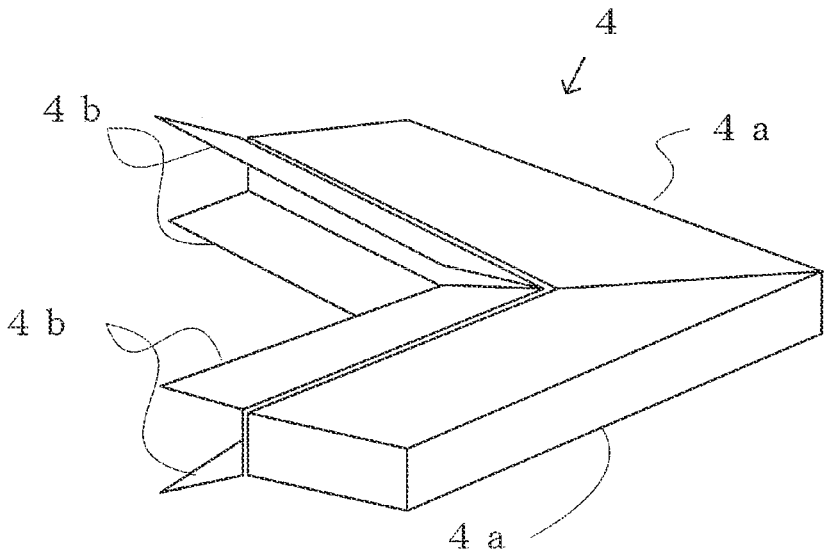
FIG. 4 is a perspective view of a corner section of the sealing member (Type 1).

FIG. 4 is a perspective view of a corner section of the sealing member (Type 1) 4, in which the peripheral frames 4*a* are connected at right angles to each other, and the sealing blades of the sealing plates 4*b* obliquely protrude like wings so as to contact the upper base 1 and the lower base 2. An opening is formed in the corner section, between the horizontally arranged sealing plate 4*b* and the vertically arranged sealing plate 4*b*, and therefore if the pressure of the hydraulic fluid 20 causes the sealing plate 4*b* to be expanded and to bend, the opening widens. If the opening is large, the force of the hydraulic fluid 20 needed to cause the upper base 1 to rise can be decreased.

Figure 5:
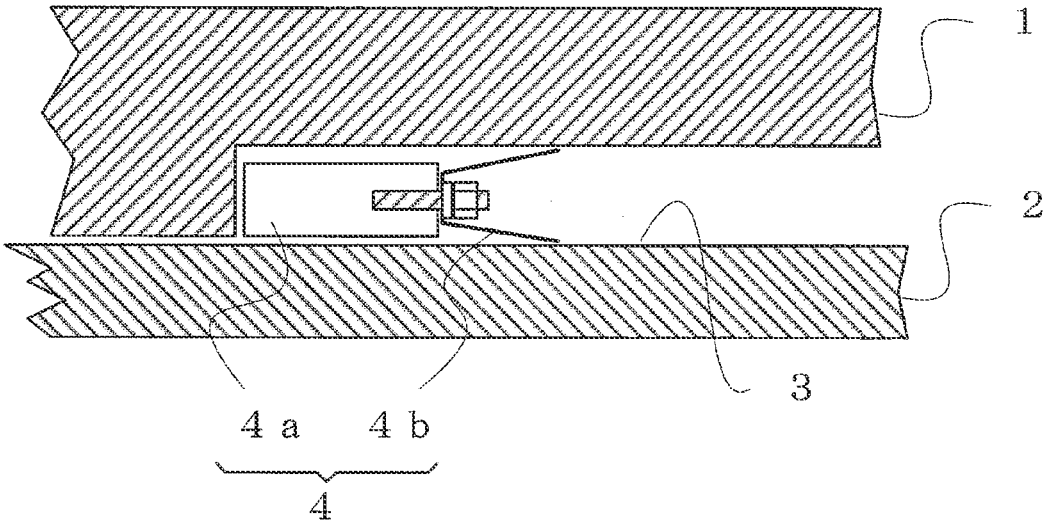
FIG. 5 is a drawing of the sealing member (Type 1) that shows how the sealing member is installed in the device o the present invention.
Figure 6:
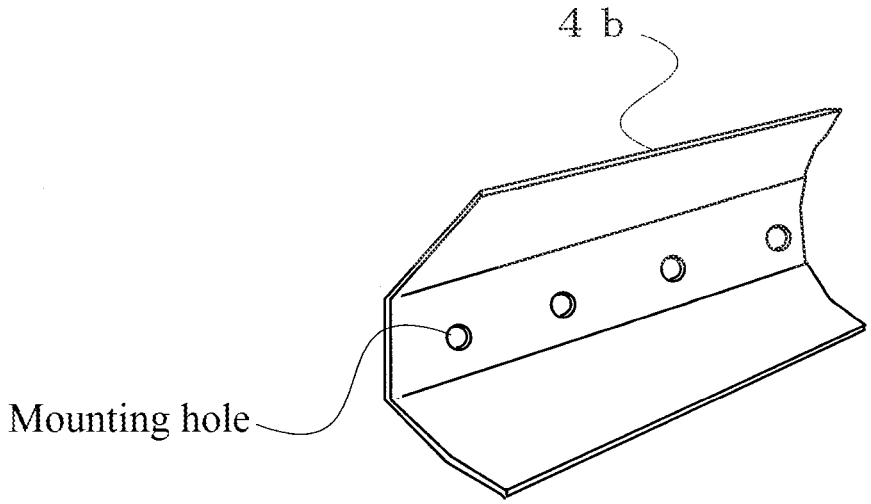
FIG. 6 is a perspective view of a sealing plate of the sealing member (Type 1).

FIG. 5 is a drawing that shows how the sealing member (Type 1) is installed in the device of the present invention. As is shown in FIG. 6, the sealing plate 4*b* is made of metal and has an elongated U-shape, widening towards the inner direction end. The ends of the widening plate portion 4*b* closely contact, the upper base 1 and the lower base 2. The sealing plate 4*b* is fixed to the peripheral frame 4*a* by bolts or the like. Because the sealing plate 4*b* is formed as a sheet, if hydraulic fluid 20 is injected inside the sealing plate 4*b*, the sealing plate 4*b* is bent by the oil pressure, which simultaneously causes the upper base 1 to rise, so as to keep the sealing blades of the sealing plate 4*b* in contact with the upper base 1 and the lower base 2.

FIG. 6 is a perspective view of a sealing plate 4*b* of the sealing member (Type 1). The sealing plate 4*b* is provided with multiple mounting holes. The material the sealing plate 4*b* can be stainless steel because stainless steel has elasticity by which the steel can return to its original size and shape after being bent.

Figure 7:
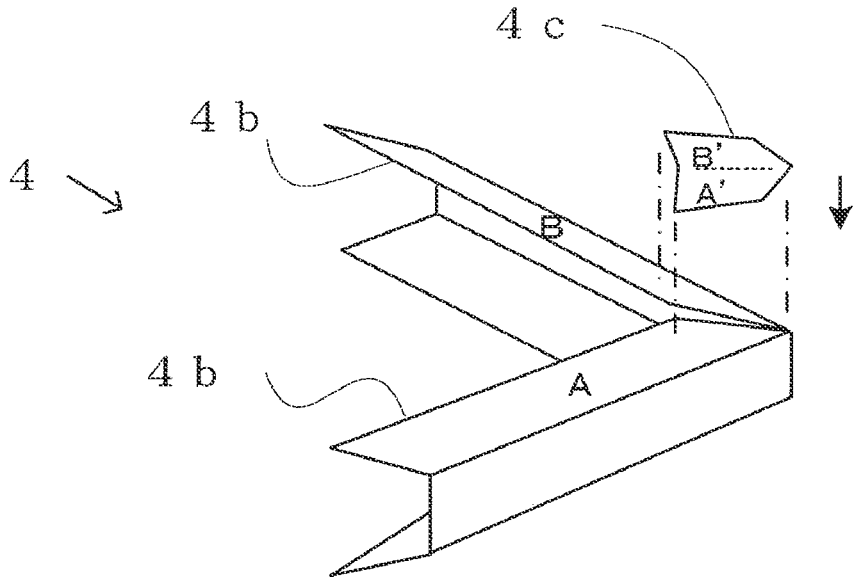
FIG. 7 is a detailed drawing of a corner section of the sealing member (Configuration 1).

FIG. 7 is a detailed drawing of the corner section of the sealing member 4 (Configuration 1). In this example, the corner section of the sealing member 4 is provided with a supplemental member 4*c* whose thickness is less than that of the sealing plate 4*b*. The supplemental member 4*c* is intended to be placed on the opening between the horizontally arranged and vertically arranged sealing plates 4*b*. The portion of the supplemental member 4*c* referred to by A' is joined to the portion of the sealing plate 4*b* referred to by A, but the portion of the supplemental member 4*c* referred to by B' is not joined to the portion of the sealing plate 4*b* referred to by B, being in a free state. If the pressure of the hydraulic fluid 20 increases, the upper sealing blade of the sealing plate 4*b* faces upward, and the opening between the sealing plate then widens. But the supplemental member 4*c* is curved and can cover the opening, which decreases the amount of the hydraulic fluid 20 that leaks from the opening into the storage section 8.

Figure 8:
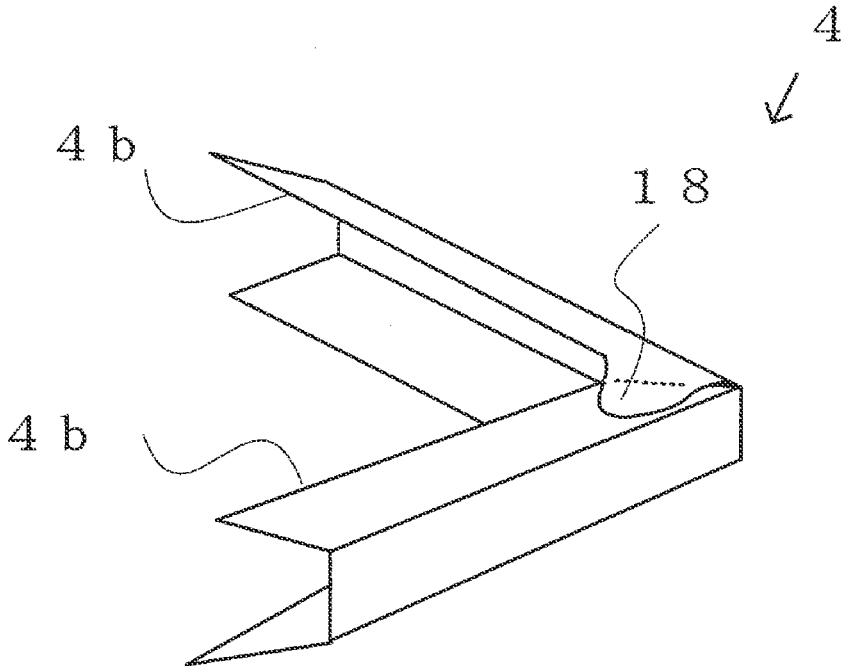
FIG. 8 is a detailed drawing of a corner section of the sealing member (Configuration 2).

FIG. 8 is a detailed drawing of the corner section of the sealing member 4 (Configuration 2). In this example, the corner section of the sealing member 4 is configured such that the sealing blades of the sealing plate 4*b* overlap each other. The overlapping part 18 is thinner than the rest of the sealing plate 4*b*. If the pressure of the hydraulic fluid 20 increases, the sealing blades of the sealing plate 4*b* bend upward a little and the lower sealing blades 4*i* bend downward a little, in such a way that the sealing-plate 4*b* opens a little wider. The overlapping part 18 is curved so that it covers the opening between the horizontally arranged and vertically arranged sealing plates 4*b*, which decreases the amount of the hydraulic fluid 20 that leaks from that opening into the storage section 8.

Figure 10:
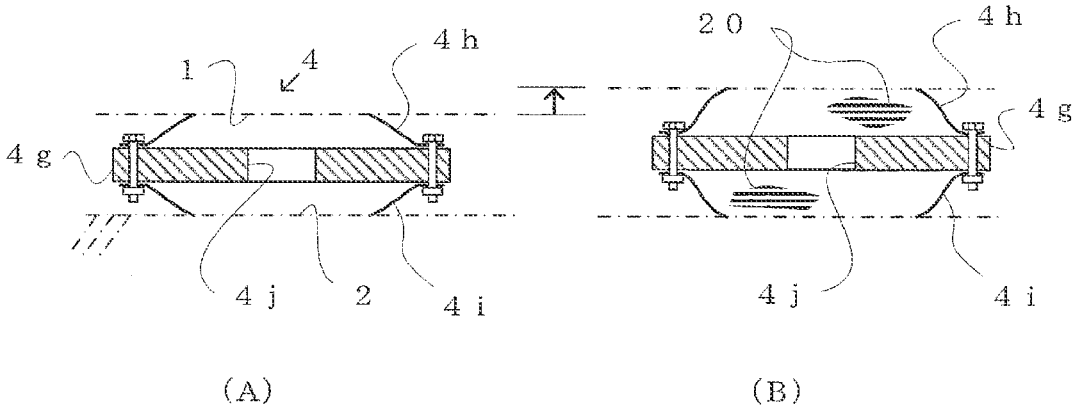

FIG. 9 shows another example of the sealing member (Type 2). The sealing member 4 (Type 2) includes (1) rectangular metal base plates 4*g* that are installed in the inner walls of the cavity 3; (2) an upper sealing blade 4*h* on the upper surface of the base plate 4*g*; and (3) a lower sealing blade 4*i* on the lower surface of the base plate 4*g* (FIG. 10). The base plate 4*g* has through holes 4*j* that allow the hydraulic fluid 20 coming from the valve 6 to spread across both the upper and lower sides of the base plate 4*g*. The through hole 4*j* in the middle is also used as an insertion hole into which the valve 6 is inserted.

FIGS. 10(A) and 10(B) are sectional views of the sealing member viewed along the line indicated by A-A in FIG. 9. FIG. 10(A) shows the state of the sealing member when the device of the present invention does not cause an upper base to rise, and FIG. 10(B) shows the state when the device of the present invention causes an upper base to rise. If the pressure of the hydraulic fluid 20 supplied to the cavity 3 increases, the upper sealing blade 4*h* faces upward and the lower sealing blade 4*i* faces downward. This forms cavity 3 as a closed space between the upper base 1 and the lower base 2, whereby the upper base 1 is lifted due to the pressure of the hydraulic fluid 20.

FIG. 11 is a perspective view of the state when the sealing members 4 are laid underneath a building. As shown in FIG. 11, the sealing members 4 are connected and inserted underneath the building. This connection of the sealing members 4 and their insertion underneath the building is repeated so that the sealing members 4 are laid underneath the entirety of the building. The sealing members 4 are able to be easily withdrawn from underneath the building because the sealing members 4 are connected to one another by connector fittings 4*d*. Also, in order to cope with an earthquake directly beneath the area where the building is located, the upper base 1 has housing holes 23, each of which houses a jack-type absorber 22.

FIG. 12 is a sectional view of a jack-type absorber 22. The jack-type absorber 22 includes a piston 22*a* and a cylinder 22*b* whose is filled with absorber oil 24. In an ordinary state, the jack-type absorber 22 causes the upper base 1 to rise, preventing the upper base 1 from contacting the lower base 2. When the lower base 2 rises due to an earthquake occurring directly beneath the area where the building is located, the piston 22*a* is pushed down so that the absorber oil 24 is pushed out to a pipe and flows via an outlet valve. Thus, the vibrational energy of the lower base 2 is absorbed by the jack-type absorber 22. During these processes, hydraulic fluid 20 is supplied into the sealing member 4 so that the upper base 1 rises at the same time that the lower base 2 rises.

FIG. 13 is a sectional view of a valve 6. The valve device 6 is a double pipe 6*a* that includes an outer pipe 6*aa* and an inner pipe 6*ab*. The outer pipe 6*aa*, which has a cap 6*e* on its top, is fixed to the upper base 1. The inner pipe 6*ab* contacts the lower base 2 due to the weight of the inner pipe 6*ab*. In the state shown in FIG. 13, the injection port 6*b* of the outer pipe 6*aa* corresponds to that of the inner pipe 6*ab*, and thereby hydraulic fluid 20 from the oil pump 31 is injected into the cavity 3 through a discharge port 6*c* provided on the bottom of the inner pipe 6*ab*. If hydraulic fluid 20 is injected into the cavity 3 and the pressure in the cavity 3 gradually increases, the upper base 1 rises. In that case, as is shown in the circle of FIG. 13, the outer pipe 6*aa* also rises relative to the inner pipe 6*ab*, so that the opening that enables connection and that is formed by the injection port 6*b* of the outer pipe 6*aa* and that of the inner pipe 6*ab* can be closed. Thus, the double-pipe configuration allows the injection port 6*b* to function as a valve. That is, said opening formed by the injection ports 6*b* also functions as a valve part 6*f*. An O-ring 6*d* is provided on the inner pipe 6*ab* between the outer pipe 6*aa* and the inner pipe 6*ab*, and therefore hydraulic fluid 20 does not leak via the gap between the outer pipe 6*aa* and the inner pipe 6*ab*.

The valve 6 shown in FIG. 13 is provided to each of the cassettes 21 as shown in FIG. 11. Therefore, if the weight of a part of a building is heavier than the weight of another part, is placed, the hydraulic fluid 20 is injected more slowly into the sealing member 4 of the cassettes 21 on which the heavier part of the building is placed than into the sealing member 4 in the cassettes on which the lighter part of the building is placed. Accordingly, the valve part 6*f* of the injection port 6*b* is not closed in the cassettes on which the heavier part of the building is placed, while is closed in the cassettes on which the lighter part of the building is placed. Thus, the injection of the hydraulic fluid 20 into the cassettes 21 on which the heavier part is placed continues until the upper base 1 rises and the valve part 6*f* of the injection port 6*b* closes. In contrast, in the cassettes on which the lighter part is placed, the upper base 1 has risen and the valve part 6*f* of the injection port 6*b* has closed, so that the injection of the hydraulic fluid 20 is stopped. Accordingly, the injection of the hydraulic fluid 20 and the stopping of the injection thereof are automatically performed, and therefore an intricate arrangement of a valve mechanism is not required. Because power failures might occur when an earthquake occurs, it is preferable not to use a valve that includes a complicated electronic circuit, because such a device requires a large battery, which makes the size of a vibration-isolation device larger.

FIG. 14 is a drawing of a hydraulic-fluid supply device 30. The hydraulic fluid supply device 30 includes an oil pump 31, an oil tank 32, and an oil chamber 33. The hydraulic-fluid supply device 30 allows, by use of a control unit, a control valve 34 to open first, and then closes a control valve 35, so that high-pressure hydraulic fluid 20 is accumulated in the oil chamber 33 by use of the oil pump 31. Thus, when an earthquake occurs, the control valve 35 opens, so that the hydraulic fluid 20 is immediately sent to the cavity 3. As an alternative path for the hydraulic fluid 20, a bypass (not shown) that does not pass through the oil chamber 33 is also provided. Thus, if the pressure in the cavity 3 decreases before the high-pressure hydraulic fluid 20 is again accumulated in the oil chamber 33, the control valve 35 provided at the outlet of the oil chamber 33 closes, and hydraulic fluid 20 is supplied directly by the oil pump 31 to the valve 6 via the bypass.

FIGS. 15(A) and 15(B) are sectional views showing other examples of the sealing member (Types 3 and 4). FIG. 15(A) shows an example in which sealing blades 4*h* are provided on one side of the sealing member. These sealing blades 4*h* are suitable if it is not necessary for a building to rise significantly. When an earthquake occurs, the hydraulic fluid 20 is injected into the space formed by both of said sealing blades 4*h*. Therefore, the base member 4*g* and the lower base 2 shake together during the earthquake, so that only the lower side of the upper base 1 slides relative to the upper base 1, whereby the building, including the upper base 1, will not move. FIG. 15(B) shows an example in which a sealing blade has a pleated shape, which is suitable if it is necessary for the building to rise significantly. If a pleated-shape sealing blade is used, it is preferable for the sealing member 4 to have a cylindrical shape.

FIG. 16 is a sectional view of a high-pressure cylinder. The high-pressure cylinder 25 includes an inner cylinder 25*a* and an outer cylinder 25*b*. The inner cylinder 25*a*, which is without its top and bottom, penetrates the outer cylinder 25*b* and is fitted into the outer cylinder 25*b*. A spring 26 is provided on the upper part of the inner cylinder 25*a* so as to prevent the inner cylinder 25*a* from colliding with the outer cylinder 25*b*. An O-ring 27 is inserted into the gap between the inner cylinder 25*a* and the outer cylinder 25*b*, so as to prevent leakage of the hydraulic fluid 20. When an earthquake is detected and hydraulic fluid 20 is injected inside the outer cylinder 25*b*, the outer cylinder 25*b* rises due to the pressure of the hydraulic fluid 20, and thereby the upper base 1 and the building are caused to rise. Also, the lower part of the inner cylinder 25*a* is slidable relative to the lower base 2.

When sealing members 4 are used for the vibration-isolation device, the area over which the upper base 1 and the lower base 2 face each other is large. However, when high-pressure cylinders 25 are used for the vibration-isolation device, the high-pressure cylinders 25 are sporadically disposed so as to support the upper base 1, and therefore the area over which the bases 1 and 2 face each other when high-pressure cylinders 25 are used is smaller than that when sealing members 4 are used. Accordingly, the use of sealing members 4 enables low pressure to cause a building to rise, although a large amount of hydraulic fluid 20 is required. In comparison with this, the use of high-pressure cylinders 25 requires a smaller amount of hydraulic fluid 20 but a higher pressure to cause a building to rise. Therefore, for example, high-pressure cylinders 25 can be used instead of jack-type absorbers when sealing members 4 are used for the device of the present invention. In that case, it is not necessary for the building usually to be raised, when earthquakes are not occurring, and, instead, after P waves are detected the device causes the building to rise within seconds by driving the high-pressure cylinder 25, and even if the upper base 1 moves down, the spring 26 and the inner cylinder 25*a* can absorb the shocks of the earthquake.

In the preceding descriptions of the examples, hydraulic fluid is used, but air can be used instead of the fluid. If air is used, the storage section 8 or the oil tank 32 used to store hydraulic fluid is not required, and the oil chamber 33 can be used as a compressed-air tank.

INDUSTRIAL APPLICABILITY

The preceding examples of the cassette-vibration isolation device of the present invention can cause a heavy building to rise during an earthquake by using hydraulic fluid, and therefore the vibration-isolation device of the invention is suitable for protecting facilities such as nuclear-reactor structures.

LIST OF REFERENCE SIGNS USED IN THE SPECIFICATION AND DRAWINGS

1 upper base
2 lower base
3 cavity
4 sealing member
4*a* peripheral flame
4*b* sealing plate
4*c* supplemental member
4*d* connector fitting
4*g* base plate
4*h* upper sealing blade
4*i* lower sealing blade
4*j* through hole
6 valve
6*a* double pipe
6*aa* outer pipe
6*ab* inner pipe
6*b* injection port
6*c* discharge port
6*d* O-ring
6*e* be cap
6*f* valve part
7 returning means
8 storage section
9 lid
10 sill
18 overlapping part
20 hydraulic fluid
21 cassette
22 jack-type absorber
22*a* piston
22*b* cylinder
23 housing hole
24 absorber oil
25 high-pressure cylinder
25*a* inner cylinder
25*b* outer cylinder
26 spring
27 O-ring
30 hydraulic-fluid supply device
31 oil pump
32 oil tank
33 oil chamber
34 control valve
35 control valve
100 cassette-vibration isolation device

The invention claimed is:

1. A cassette-vibration isolation device comprising:

an upper base and a lower base that are arranged so that the bottom surface of the upper base faces the upper surface of the lower base;

a cavity that is formed between the upper base and the lower base and that is filled with fluid;

a sealing member including:

a peripheral frame that is arranged along the inner walls of the cavity, and a thin sealing plate that is provided along the entire inner circumference of the peripheral frame and that elastically contacts the upper and lower surfaces of the cavity, wherein the sealing member is configured so that a width of the sealing member is adjusted to a width of compartments into which the cavity is divided, and that multiple sealing members can be connected—in the direction in which they are inserted into the cavity of the sealing members—to one another, and the sealing member can be attached to and detached from the cavity by being inserted into and withdrawn from the inside of the cavity, such that that the sealing member maintains the fluid filled inside the cavity; and a valve that connects the cavity with a fluid-supply source and that supplies the fluid to the inside of the cavity, wherein, during an earthquake, the upper base can rise from the lower base due to fluid being supplied from the valve to the inside of the cavity.

2. The cassette-vibration isolation device according to claim 1, and wherein a storage section, into which the fluid in the cavity flows, is further provided, so that the fluid is stored therein.

3. The cassette-vibration isolation device according to claim 1, and wherein there is further provided a returning means that applies pressure to the upper base after the upper base has been raised, and that lowers the upper base to its original position.

4. A cassette-vibration isolation device comprising:

an upper base and a lower base that are arranged so that the bottom surface of the upper base faces the upper surface of the lower base;

a cavity that is formed between the upper base and the lower base and that is filled with fluid;

a sealing member comprising:

a rectangular metal base plate that has multiple through holes;

an upper sealing blade that extends along the periphery of the upper surface of the base plate; and a lower sealing blade that extends along the periphery of the lower surface of the base plate, wherein the sealing member can be attached to and detached from the cavity by being inserted into and withdrawn from the inside of the cavity, and wherein the sealing member maintains the fluid filled inside the cavity; and a valve that connects the cavity with a fluid-supply source and that supplies the fluid to the inside of the cavity, wherein, during an earthquake, the upper base can rise from the lower base due to fluid being supplied from the valve to the inside of the cavity.

5. A cassette-vibration isolation device comprising:

an upper base and a lower base that are arranged so that the bottom surface of the upper base faces the upper surface of the lower base;

a cavity that is formed between the upper base and the lower base and that is filled with fluid;

a sealing member that is attachably and detachably provided along the inner walls of the cavity, and that maintains the fluid filled inside the cavity; and a valve that connects the cavity with a fluid-supply source and that supplies the fluid to the inside of the cavity, wherein the valve has a double-pipe structure that includes an outer pipe that is fixed on the upper base when the outer pipe penetrates through the upper base, and an inner pipe that is inserted into the outer pipe so as to be able to move up and down relative to the outer pipe, and that has a fluid-discharge port that is formed on the lower part of the inner pipe and opened to the inside of the cavity; and a fluid-injection port that is formed at corresponding positions in the inner pipe and the outer pipe, whereby the relative movement of the inner pipe and the outer pipe, due to the rise of the upper base establishes or breaks a connection between the injection port of the inner pipe and the injection port of the outer pipe, wherein, during an earthquake, the upper base can rise from the lower base due to fluid being supplied from the valve to the inside of the cavity.

6. The cassette-vibration isolation device according to claim 5, and wherein a valve is provided to each of the multiple sealing members, which are provided so that they divide the cavity into separate sections.

7. A cassette-vibration isolation device comprising:

an upper base and a lower base that are arranged so that the bottom surface of the upper base faces the upper surface of the lower base;

a cavity that is formed between the upper base and the lower base and that is filled with fluid;

a sealing member that is attachably and detachably provided along the inner walls of the cavity, and that maintains the fluid filled inside the cavity; and a valve that connects the cavity with a fluid-supply source and that supplies the fluid to the inside of the cavity; and a plurality of jack-type absorbers provided between the upper base and the lower base, wherein the weight of a building, including the upper base, is supported by oil pressure of at least one of the jack-type absorbers in an ordinary state; and, when an earthquake is detected, an outlet valve of the at least one of the jack-type absorbers is opened so as to decrease the internal pressure of the at least one of the jack-type absorbers, so that the upper base moves down to increase the pressure of the fluid that has filled the cavity, whereby, even before the valve supplies the fluid into the cavity, the shocks of the earthquake are absorbed.

8. A cassette-vibration isolation device comprising:

an upper base and a lower base that are arranged so that the bottom surface of the upper base faces the upper surface of the lower base;

a cavity that is formed between the upper base and the lower base and that is filled with fluid;

a sealing member that is attachably and detachably provided along the inner walls of the cavity, and that maintains the fluid filled inside the cavity; and a valve that connects the cavity with a fluid-supply source and that supplies the fluid to the inside of the cavity, the fluid-supply source including an oil tank that stores the fluid, an oil pump that pumps the fluid upward from the oil tank, and an oil chamber that compresses and stores the fluid, whereby the fluid is sent from the oil chamber to the valve, wherein, during an earthquake, the upper base can rise from the lower base due to fluid being supplied from the valve to the inside of the cavity.

* * * * *